US011516565B2

(12) United States Patent
Chen et al.

(10) Patent No.: US 11,516,565 B2
(45) Date of Patent: Nov. 29, 2022

(54) SOUND TRANSMISSION DEVICE

(71) Applicant: LUXSHARE-ICT CO., LTD., Taipei (TW)

(72) Inventors: Hsing-Chia Chen, Taipei (TW); Chen-Yu Chung, Taipei (TW); Ta-Yu Lin, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 0 days.

(21) Appl. No.: 17/381,818

(22) Filed: Jul. 21, 2021

(65) Prior Publication Data

US 2021/0352388 A1 Nov. 11, 2021

(30) Foreign Application Priority Data

Jan. 19, 2021 (TW) ..... 110200655

(51) Int. Cl.

| | |
|---|---|
| ***H04R 25/00*** | (2006.01) |
| ***H04R 1/02*** | (2006.01) |
| ***H04R 9/02*** | (2006.01) |
| ***H04R 1/10*** | (2006.01) |

(52) U.S. Cl.

CPC ..... *H04R 1/02* (2013.01); *H04R 1/10* (2013.01); *H04R 9/025* (2013.01)

(58) Field of Classification Search

CPC .... H04R 1/1008; H04R 1/105; H04R 1/1066; H04R 1/1075; H04R 1/1083; H04R 5/0335

See application file for complete search history.

(56) References Cited

U.S. PATENT DOCUMENTS

2018/0184193 A1* 6/2018 Zheng ..... H04R 1/105
2022/0038805 A1* 2/2022 Lauridsen ..... H04R 1/1058

FOREIGN PATENT DOCUMENTS

CN 209731531 U 12/2019
CN 111698606 A 9/2020

* cited by examiner

*Primary Examiner* — Amir H Etesam

(74) *Attorney, Agent, or Firm* — Birch, Stewart, Kolasch & Birch, LLP

(57) ABSTRACT

A sound transmission device includes a main body, a first magnetic member, and a cover assembly. The main body includes a sound transmission opening. The first magnetic member is fixed to the main body and is adjacent to the sound transmission opening. The cover assembly includes an outer cover, a second magnetic member, and a fixing member. The second magnetic member is fixed between the outer cover and the fixing member. The cover assembly is magnetically attached to the first magnetic member through the second magnetic member, so that the outer cover covers the sound transmission opening. The outer cover includes a through hole, and the through hole is in communication with the sound transmission opening.

19 Claims, 6 Drawing Sheets

SOUND TRANSMISSION DEVICE

CROSS-REFERENCE TO RELATED APPLICATION

This non-provisional application claims priority under 35 U.S.C. § 119(a) to Patent Application No. 110200655 filed in Taiwan, R.O.C. on Jan. 19, 2021, the entire contents of which are hereby incorporated by reference.

BACKGROUND

Technical Field

The instant disclosure relates to a transmission device, and in particular, to a sound transmission device.

Related Art

Sound transmission devices are widely used in various products on the market. For example, a sound transmission device may be a sound playback device (such as an earphone, a loudspeaker, a speaker, or the like) or a sound receiving device (such as a microphone). In order to prevent foreign objects from entering the sound transmission device, a cover body is generally provided in the sound transmission device in a channel for transmission of sound waves to achieve the effect of protection.

However, after long-time use of the sound transmission device, many foreign objects (such as water, dust, earwax) are accumulated on the cover body, or the cover body is damaged, which may affect sound transmission quality of the sound transmission device. Since the cover body of the sound transmission device is mostly non-detachably mounted presently, for example, assembled from inside to outside and bonded through spot welding or dispensing. Therefore, the cover body cannot be randomly disassembled for cleaning or replacement.

SUMMARY

In view of the above, in an embodiment, a sound transmission device is provided, including a main body, a first magnetic member, and a cover assembly. The main body includes a sound transmission opening. The first magnetic member is fixed to the main body and is adjacent to the sound transmission opening. The cover assembly includes an outer cover, a second magnetic member, and a fixing member. The second magnetic member is fixed between the outer cover and the fixing member. The cover assembly is magnetically attached to the first magnetic member through the second magnetic member, so that the outer cover covers the sound transmission opening. The outer cover includes a through hole, and the through hole is in communication with the sound transmission opening.

Based on the above, according to the sound transmission device of the embodiment of the instant disclosure, the cover assembly is magnetically attached to the first magnetic member through the second magnetic member, so that the cover assembly is fixed to the main body and covers the sound transmission opening, which can prevent foreign objects (such as water, dust, earwax) from entering the sound transmission device and facilitate faster and more convenient assembling. In addition, if the cover assembly needs to be disassembled, the second magnetic member of the cover assembly can be attached through other magnetic members to separate the cover assembly from the main body, so that the cover assembly can be easily removed for cleaning, maintenance, or replacement without breaking the structure, thereby ensuring the sound transmission quality of the sound transmission device.

DETAILED DESCRIPTION

Figure 1:
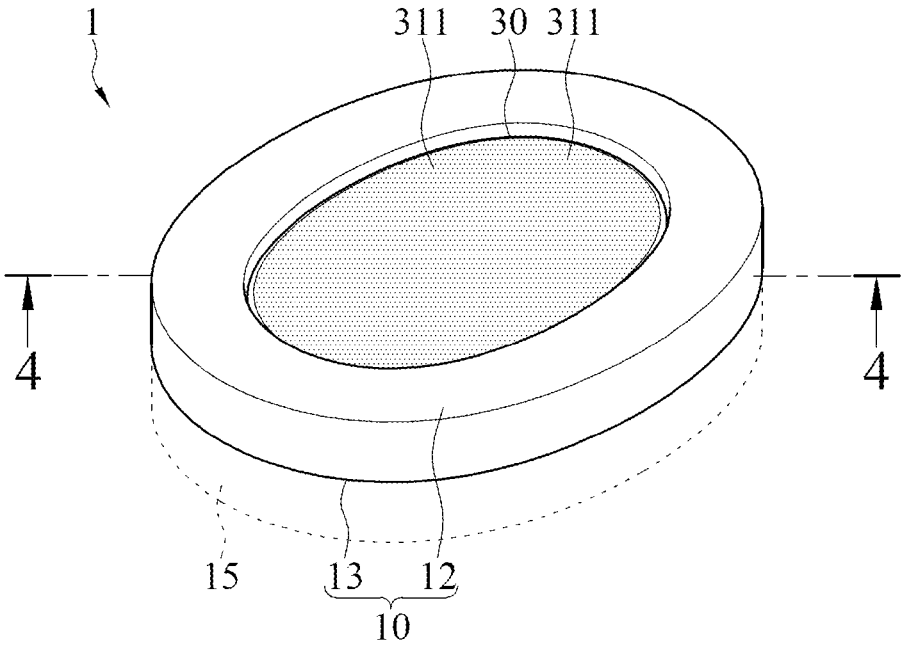
FIG. 1 is a three-dimensional view of a sound transmission device according to a first embodiment of the instant disclosure.

Various embodiments are provided below for detailed description. However, the embodiments are merely used as examples for illustration, and do not limit the protection scope of the instant disclosure. In addition, some elements are omitted in the drawings in the embodiments to clearly show the technical features of the instant disclosure. The same reference numerals are used to indicate the same or similar elements in all of the drawings.

Figure 2:
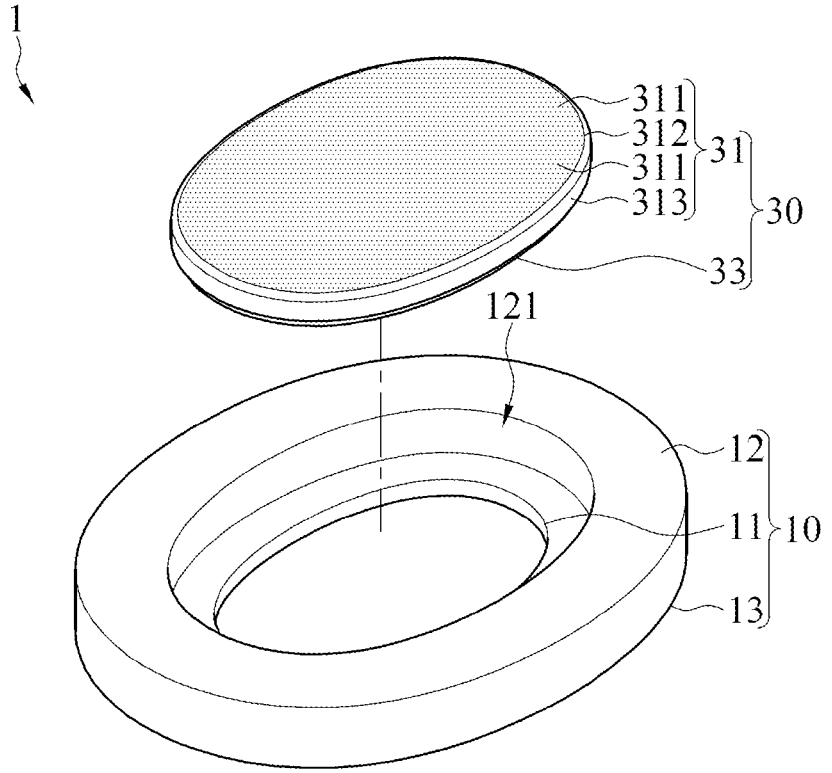
FIG. 2 is a three-dimensional exploded view of the sound transmission device according to the first embodiment of the instant disclosure.
Figure 3:
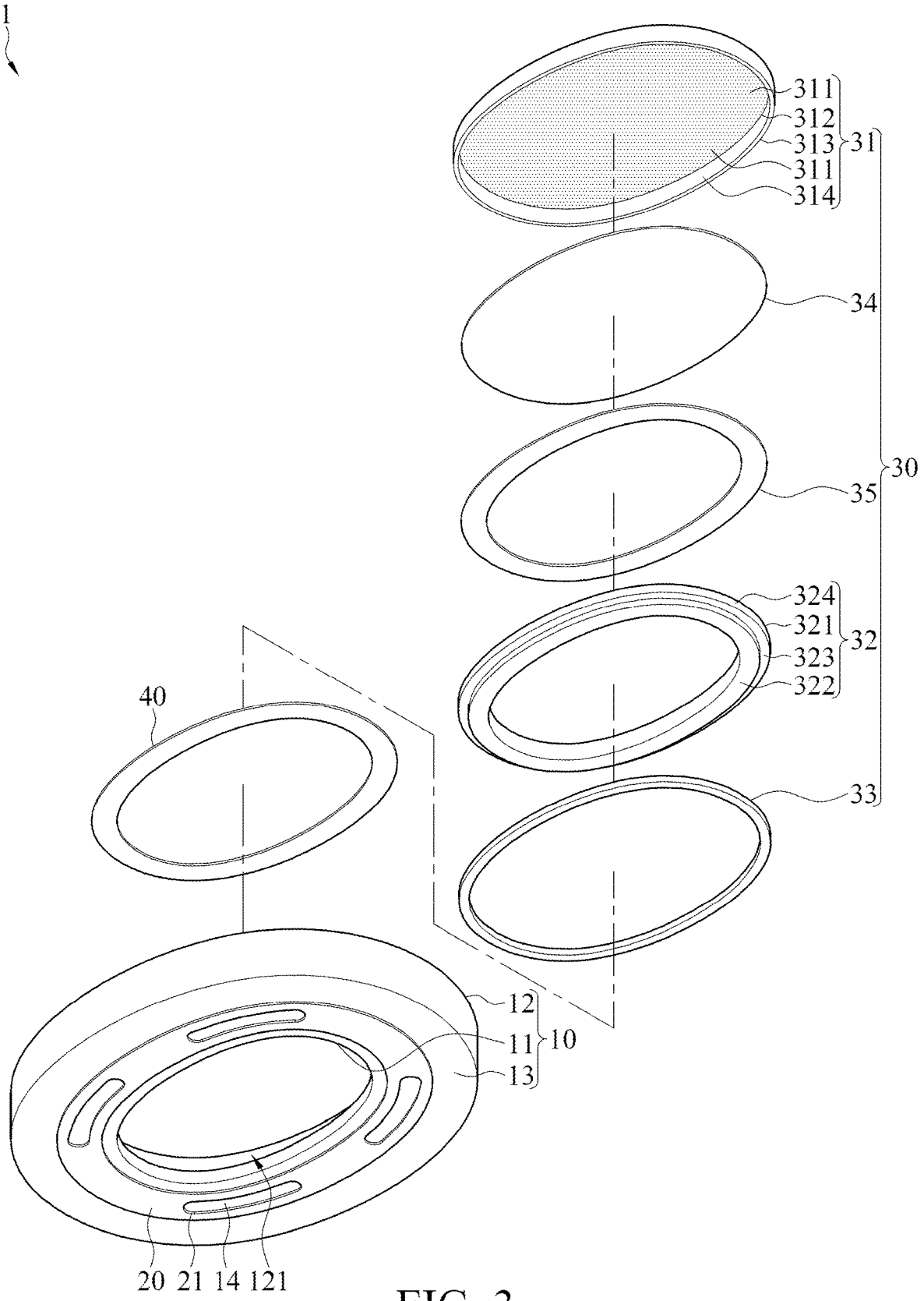
FIG. 3 is another three-dimensional exploded view of the sound transmission device according to the first embodiment of the instant disclosure.
Figure 4:
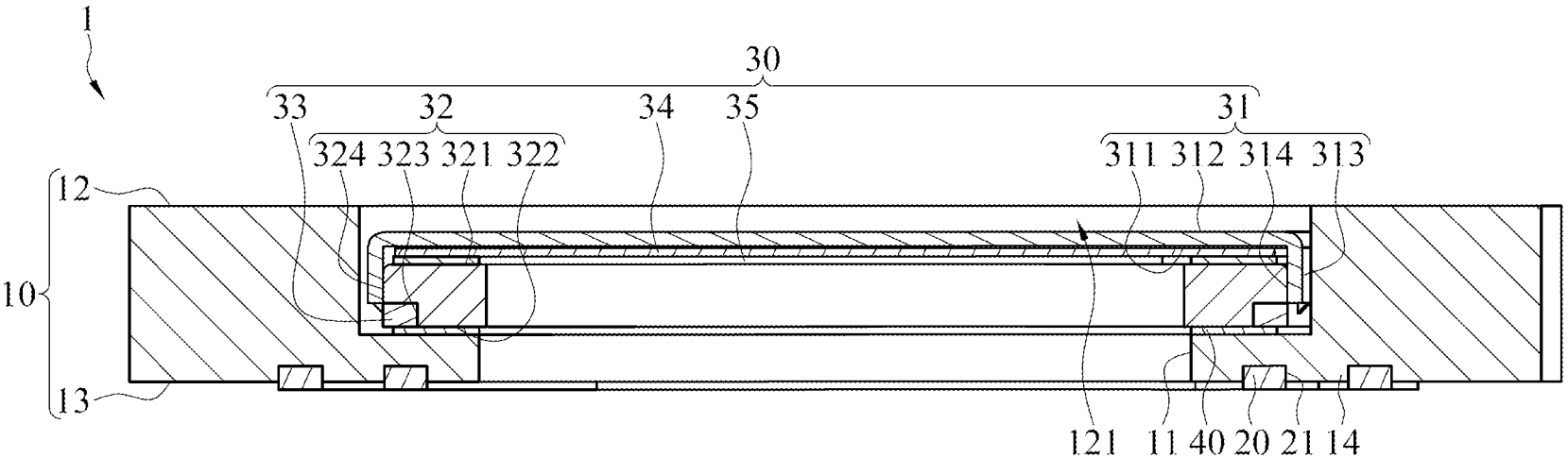
FIG. 4 is a cross-sectional view of the sound transmission device according to the first embodiment of the instant disclosure.

FIG. 1 is a three-dimensional view of a sound transmission device according to a first embodiment of the instant disclosure. FIG. 2 is a three-dimensional exploded view of the sound transmission device according to the first embodiment of the instant disclosure. FIG. 3 is another three-dimensional exploded view of the sound transmission device according to the first embodiment of the instant disclosure. FIG. 4 is a cross-sectional view of the sound transmission device according to the first embodiment of the instant disclosure. As shown in FIG. 1 to FIG. 4, in this embodiment, a sound transmission device 1 includes a main body 10, a first magnetic member 20, and a cover assembly 30. The sound transmission device 1 may be a sound playback device (such as an earphone, a loudspeaker, a speaker, or the like) or a sound receiving device (such as a microphone).

As shown in FIG. 1 to FIG. 4, the main body 10 is made of plastic, metal, or wood, for example, and may be manufactured through stamping, casting, injection molding, or the like. In this embodiment, the main body 10 is a hollow elliptical cylinder. The main body 10 includes a sound transmission opening 11, a first side surface 12, and a second side surface 13 that is opposite to the first side surface 12. The sound transmission opening 11 penetrates the first side surface 12 and the second side surface 13 of the main body 10. In some embodiments, the main body 10 may also be a square column, a rectangular column, a cylinder, or other hollow columns.

As shown in FIG. 1 to FIG. 4, the first side surface 12 of the main body 10 is provided with an accommodating groove 121. In this embodiment, the accommodating groove 121 is an elliptical groove, which may be formed through stamping, drilling, milling, turning, or other machining methods. Alternatively, the accommodating groove 121 may also be formed integrally with the main body 10 through stamping, casting, injection molding, or the like. In some embodiments, the accommodating groove 121 may alternatively be a square groove, a rectangular groove, or an elliptical groove.

As shown in FIG. 1 to FIG. 4, in this embodiment, the sound transmission opening 11 of the main body 10 is located at a bottom of the accommodating groove 121, and the sound transmission opening 11 is in communication with an internal space 15 of the sound transmission device 1. If the sound transmission device 1 is a sound playback device, magnets, coils, and diaphragms may be provided in the internal space 15 of the sound transmission device 1 to convert electricity into sound through the principle of electromagnetism, and then the sound is transmitted to outside through the sound transmission opening 11 to achieve the function of sound playback. If the sound transmission device 1 is a sound receiving device, the sound transmission device 1 can pick up external sound into the internal space 15 of the sound transmission device 1 through the sound transmission opening 11, and the received sound can be converted into electricity to achieve the function of sound pick-up by means of electromagnetism through magnets, coils, and diaphragms.

Based on the above, as shown in FIG. 1 to FIG. 4, in this embodiment, the sound transmission opening 11 is an elliptical transmission port, which can be formed through stamping, injection molding, or other machining ways. In some embodiments, a shape of the sound transmission opening 11 is, for example, square, rectangular, circular, or in other shapes, or there may also be a plurality of sound transmission openings 11.

As shown in FIG. 1 to FIG. 4, in this embodiment, the first magnetic member 20 is fixed to the main body 10 and adjacent to the sound transmission opening 11. Specifically, the first magnetic member 20 is annular, and the first magnetic member 20 is fixed to the second side surface 13 of the main body 10, surrounds the sound transmission opening 11, and is adjacent to the sound transmission opening 11. In some embodiments, the first magnetic member 20 may also be fixed to the first side surface 12 of the main body 10 or in the accommodating groove 121.

As shown in FIG. 1 to FIG. 4, in this embodiment, the first magnetic member 20 and the main body 10 are fixed to each other through insert molding. The first magnetic member 20 includes at least one through hole 21 (a number of through holes 21 is four herein, but this is not limited), and the main body 10 includes at least one embedded portion 14 (a number of embedded portions 14 is four herein, but this is not limited). Specifically, the manufacturing process of this embodiment is to place the first magnetic member 20 in a mold and then inject molten plastic into the mold, so that the molten plastic flows on the first magnetic member 20 and fills the through holes 21 of the first magnetic member 20. After the molten plastic is cooled and solidified to form the main body 10, and an embedded portion 14 is formed at the through hole 21 of the first magnetic member 20, the embedded portion 14 is fixed in the through hole 21 and the first magnetic member 20 is embedded in the main body 10. In this way, the first magnetic member 20 and the main body 10 are fixed to each other. In addition, by fixing the embedded portion 14 in the through hole 21, a binding force between the first magnetic member 20 and the main body 10 can be further strengthened.

In some embodiments, the above first magnetic member 20 may also be fixed to the main body 10 through other fixing methods such as locking, bonding, riveting, or the like.

As shown in FIG. 1 to FIG. 4, the first magnetic member 20 may be a magnet or a ferromagnetic member (such as metal pieces made of iron, nickel, or cobalt), which can be made through stamping, casting, die-casting, or the like. The through hole 21 of the first magnetic member 20 can be formed through drilling or other machining methods after the first magnetic member 20 is manufactured, or may be integrally made with the first magnetic member 20 simultaneously through the same process.

As shown in FIG. 1 to FIG. 4, the cover assembly 30 includes an outer cover 31, a second magnetic member 32, and a fixing member 33. The outer cover 31 includes a cover plate 312 and a circumferential plate 313. The shapes of the cover plate 312 and the accommodating groove 121 match each other. For example, in this embodiment, the cover plate 312 is an elliptical plate, and the circumferential plate 313 extends vertically from a periphery of the cover plate 312. In this embodiment, the outer cover 31 is a metal cover, which can be made integrally through stamping, drawing, or casting, or can be made through splicing. In some embodiments, the outer cover 31 may also be a plastic cover, which is made through injection molding.

As shown in FIG. 1 to FIG. 4, the outer cover 31 includes at least one through hole 311. In this embodiment, the outer cover 31 is a mesh cover body and includes a plurality of through holes 311. Under the same area of the cover plate 312, a larger number of through holes 311 and smaller sizes of the through holes 311 indicate smaller sizes of foreign objects that can enter the through hole 311. In addition, when the through holes 311 are of the same size, more through holes 311 on the outer cover 31 can improve sound penetration. Therefore, the outer cover 31 is designed as the mesh cover body, which has not only a good dustproof effect but also a good sound penetration effect.

As shown in FIG. 1 to FIG. 4, in this embodiment, the fixing member 33 is an elliptical metal ring, which can be made integrally through stamping, casting, or forging, or can be made through splicing. In some embodiments, the fixing member 33 may also be a plastic ring or a plastic steel ring, which is integrally made through injection molding.

As shown in FIG. 1 to FIG. 4, in this embodiment, the second magnetic member 32 may be a magnet or a ferromagnetic member (for example, a metal member made of iron, nickel, or, cobalt), and a magnetic attraction force can be generated between the second magnetic member and the first magnetic member 20 when the second magnetic member approaches the first magnetic member 20. For example, as shown in FIG. 4, the first magnetic member 20 and the second magnetic member 32 may both be magnets and each have an N pole and an S pole. The N pole of the first magnetic member 20 may be closer to the second side surface 13 of the main body 10 than the S pole, and the S pole of the second magnetic member 32 may be closer to the bottom of the accommodating groove 121 of the first side surface 12 than the N pole, so that the magnetic attraction force can be generated when the first magnetic member 20 and the second magnetic member 32 are close to each other.

Alternatively, if one of the second magnetic member 32 and the first magnetic member 20 is a ferromagnetic member, and the other is a magnet, the proximity of the first magnetic member 20 and the second magnetic member 32 magnetizes the ferromagnetic member, thereby forming an unlike pole and generate the magnetic attraction force.

As shown in FIG. 1 to FIG. 5, shapes of the second magnetic member 32 and the fixing member 33 match each other. In this embodiment, the second magnetic member 32 is an elliptical ring and includes a first ring portion 321, a second ring portion 322, and an annular groove 323. The second magnetic member 32 can be made through stamping, casting, die-casting, or the like. In some embodiments, the second magnetic member 32 may also be rings of other shapes such as a circular ring, a square ring, a rectangular ring, a triangular ring, or the like.

As shown in FIG. 1 to FIG. 5, in this embodiment, the second magnetic member 32 is located between the outer cover 31 and the fixing member 33, the first ring portion 321 of the second magnetic member 32 is accommodated in the outer cover 31, and the second ring portion 322 is located on a side of the first ring portion 321 that is away from the cover plate 312. An outer circumferential wall 324 of the first ring portion 321 is in contact with an inner circumferential wall 314 of the circumferential plate 313, and the second ring portion 322 is contracted relative to the outer circumferential wall 324 of the first ring portion 321 to form the annular groove 323. The fixing member 33 is accommodated in the annular groove 323 for mating with each other.

Figure 5:
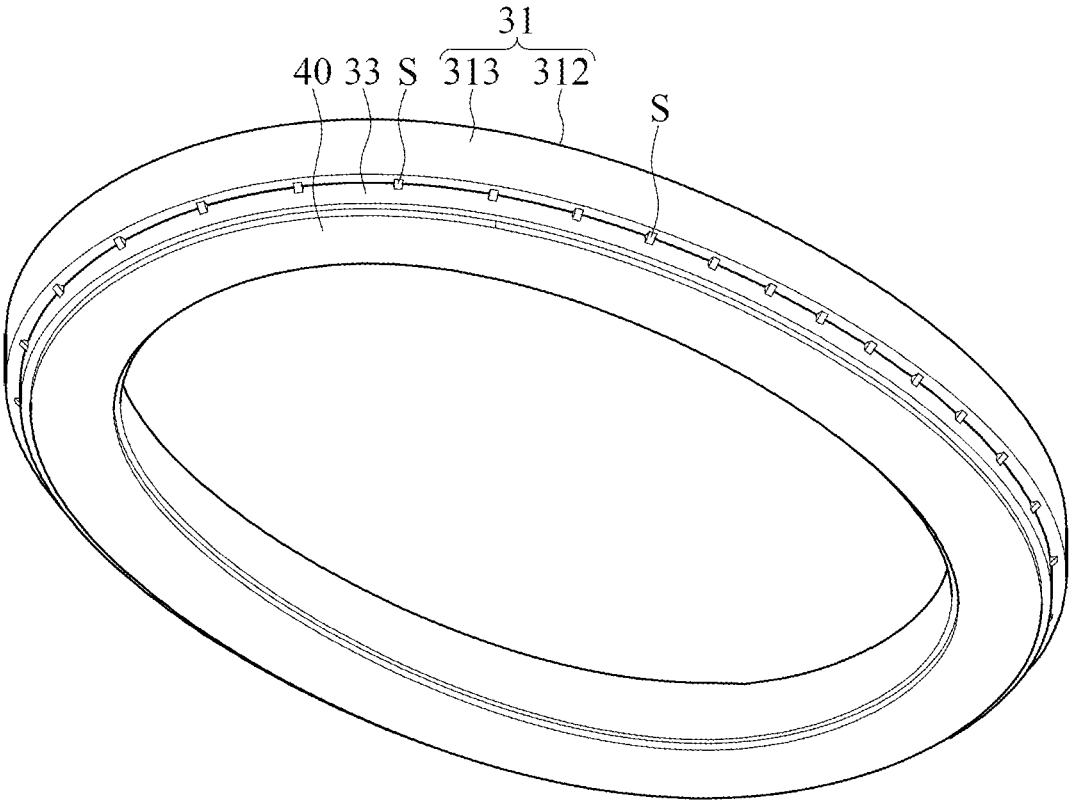
FIG. 5 is a partial three-dimensional view of the sound transmission device according to the first embodiment of the instant disclosure.

FIG. 5 is a partial three-dimensional view of the sound transmission device according to the first embodiment of the instant disclosure. As shown in FIG. 1 to FIG. 5, in this embodiment, a plurality of solder joints or welding joints are provided on an end of the circumferential plate 313 that is away from the cover plate 312 and the fixing member 33. The plurality of solder joints or welding joints are annularly arranged between the circumferential plate 313 and the fixing member 33. In this way, through soldering or welding, the end of the circumferential plate 313 that is away from the cover plate 312 and the fixing member 33 are fixed to each other, so that the second magnetic member 32 is fixed between the cover plate 312 of the outer cover 31 and the fixing member 33. In some embodiments, the end of the circumferential plate 313 that is away from the cover plate 312 and the fixing member 33 may also be fixed to each other through a fixing method such as close fitting, bonding, locking, riveting, or the like.

In some embodiments, the second magnetic member 32 may also be fixed to the fixing member 33 or inside of the outer cover 31 through casting.

Figure 6:
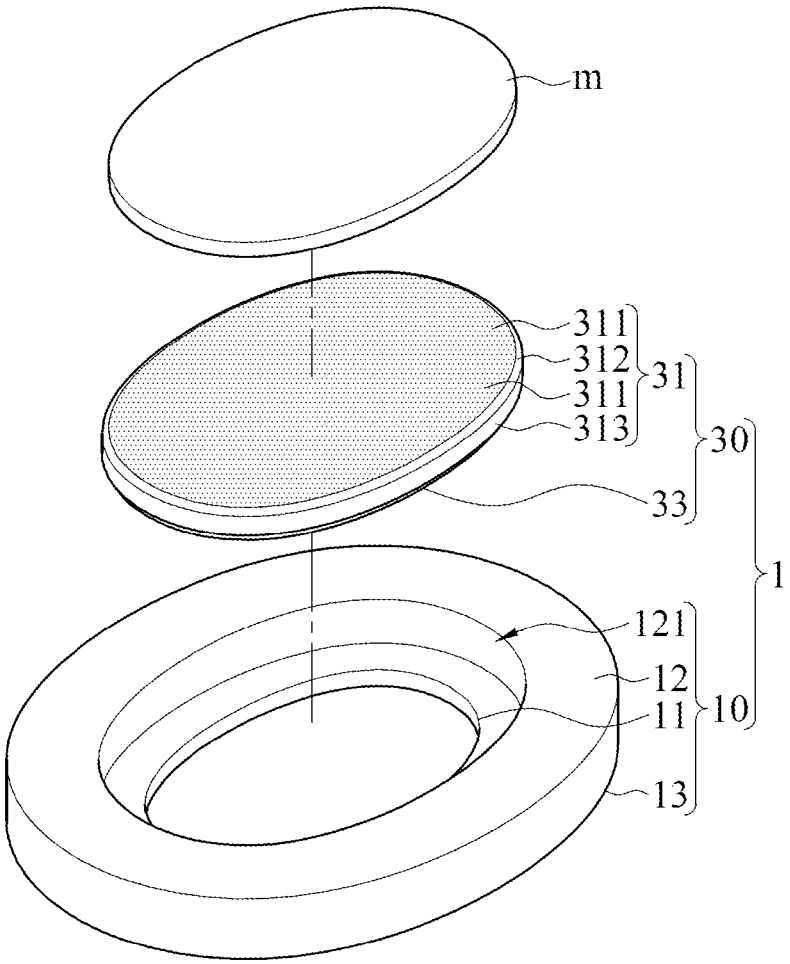
FIG. 6 is a schematic diagram of operation of the sound transmission device according to the first embodiment of the instant disclosure.

FIG. 6 is a schematic diagram of operation of the sound transmission device according to the first embodiment of the instant disclosure. As shown in FIG. 1 to FIG. 6, in this embodiment, the cover assembly 30 is magnetically attached to the first magnetic member 20 through the second magnetic member 32. In this way, a retention force between the cover assembly 30 and the main body 10 can be achieved through the magnetic attraction force between the second magnetic member 32 and the first magnetic member 20, which can ensure that the cover assembly 30 covers the sound transmission opening 11 to block foreign objects out of the main body 10, thereby achieving a filtering effect. In addition, the through hole 311 of the outer cover 31 is in communication with the sound transmission opening 11, so that the sound can freely pass through the sound transmission opening 11 and the cover assembly 30 via the through hole 311, to ensure the sound transmission quality. Moreover, as shown in FIG. 6, when the cover assembly 30 needs to be disassembled, a strong magnet m is placed at an end facing the first side surface 12 of the main body 10. The magnetic force between the strong magnet m and the second magnetic member 32 is greater than a magnetic force between the first magnetic member 20 and the second magnetic member 32, so that the cover assembly 30 can be removed.

Based on the above, according to the sound transmission device 1 of the embodiment of the instant disclosure, the cover assembly 30 is magnetically attached to the first magnetic member 20 through the second magnetic member 32, so that the cover assembly 30 is fixed to the main body 10 and covers the sound transmission opening 11, which can prevent foreign objects (such as dust, earwax) from entering the sound transmission device 1 and facilitate faster and more convenient assembling. In addition, if the cover assembly 30 needs to be disassembled, the second magnetic member 32 of the cover assembly 30 can be attached through other magnetic members to separate the cover assembly 30 from the main body 10, so that the cover assembly 30 can be easily removed for cleaning, maintenance, or replacement without breaking the structure, thereby ensuring the sound transmission quality of the sound transmission device 1.

As shown in FIG. 1 to FIG. 6, the cover assembly 30 includes a waterproof layer 34 and a sealing layer 35. In this embodiment, the waterproof layer 34 is elliptical to correspond to the shape of the sound transmission opening 11. The waterproof layer 34 may be made of other waterproof materials such as glass fiber, non-woven fabric, or the like. The sealing layer 35 is an elliptical ring to correspond to the waterproof layer 34 and the second magnetic member 32. The sealing layer 35 may be made of adhesive, waterproof film, or waterproof foam. In this embodiment, the waterproof layer 34 is fixed between the outer cover 31 and the sealing layer 35 through a fixing method such as press-fitting or bonding and covers the sound transmission opening 11, and the sealing layer 35 is fixed between the waterproof layer 34 and the second magnetic member 32 through a fixing method such as press-fitting or bonding, and surrounds the sound transmission opening 11. In some embodiments, the waterproof layer 34 may also be directly fixed between the outer cover 31 and the second magnetic member 32 without passing through the sealing layer 35.

In this way, the sound transmission device 1 of the embodiments of the instant disclosure covers the sound transmission opening 11 through the waterproof layer 34 to prevent foreign objects (such as water, beverages, or other liquids) from entering the sound transmission device 1. In addition, the sealing layer 35 is located between the waterproof layer 34 and the second magnetic member 32 and surrounds the sound transmission opening 11, so that sealing performance of the waterproof layer 34 and the second magnetic member 32 can be improved, further ensuring the waterproof capability of the sound transmission device 1.

As shown in FIG. 1 to FIG. 6, in this embodiment, the sound transmission device 1 further includes a seal ring 40. The seal ring 40 may be made of the material of the above sealing layer 35. The seal ring 40 is fixed between the cover assembly 30 and the main body 10 through positioning methods such as press-fitting or bonding, and surrounds the sound transmission opening 11 to improve the sealing performance of the cover assembly 30 and the main body 10, further ensuring the waterproof capability of the sound transmission device 1. In some embodiments, the seal ring 40 is disposed at the bottom of the accommodating groove 121 and may be attached to the cover assembly 30. The seal ring 40 facilitates fixing of the cover assembly 30 in the accommodating groove 121 more firmly. In some embodiments, an adhesive force provided by the seal ring 40 is relatively low, so that the magnetic force between the strong magnet m and the second magnetic member 32 can be set to be greater than the magnetic force between the first magnetic member 20 and the second magnetic member 32 plus the adhesive force provided by the seal ring 40. Therefore, the cover assembly 30 can still be removed through the strong magnet m.

Figure 7:
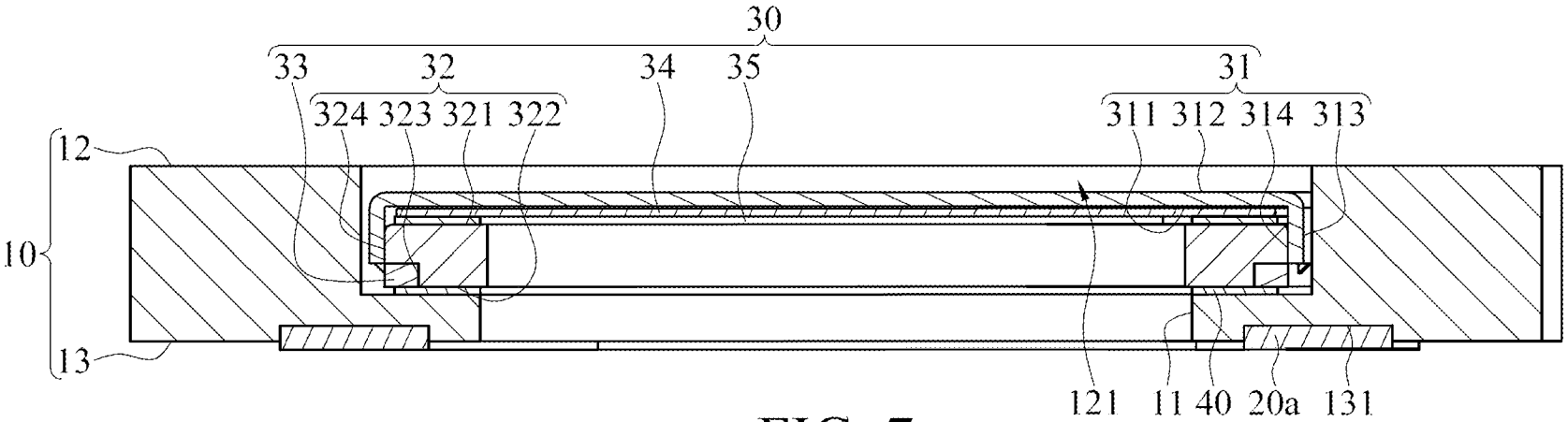
FIG. 7 is a cross-sectional view of the sound transmission device according to a second embodiment of the instant disclosure.
Figure 8:
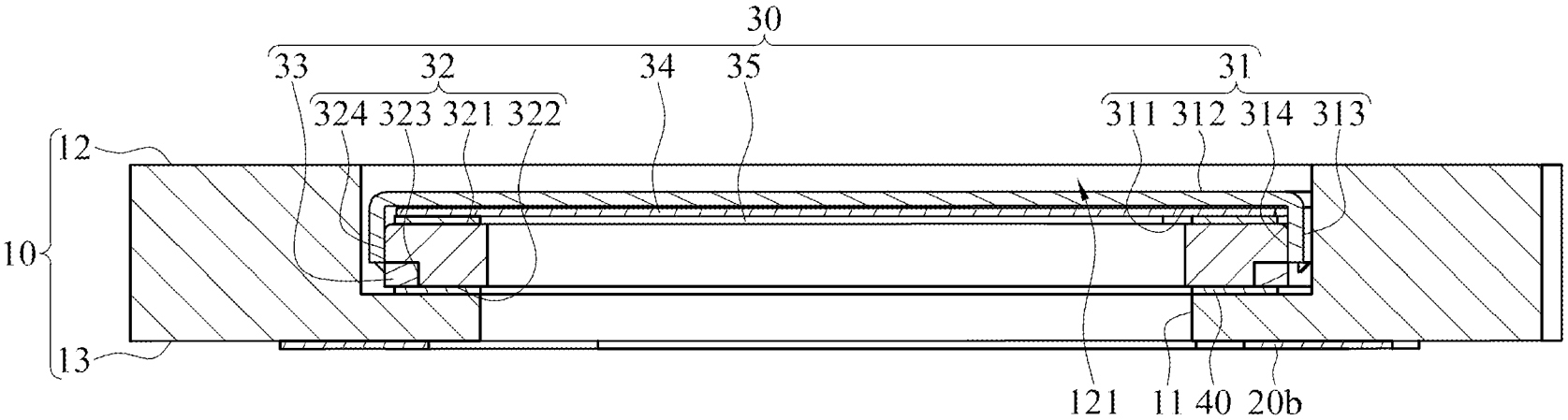
FIG. 8 is a cross-sectional view of the sound transmission device according to a third embodiment of the instant disclosure.

There are still various ways of fixing the first magnetic member 20 and the main body 10, which are described below. FIG. 7 is a cross-sectional view of the sound transmission device according to a second embodiment of the instant disclosure. FIG. 8 is a cross-sectional view of the sound transmission device according to a third embodiment of the instant disclosure. As shown in FIG. 7, a difference between this embodiment and the first embodiment is that in this embodiment, the first magnetic member 20*a* does not include the through hole 21, and the first magnetic member 20*a* has an annular groove 131. The annular groove 131 may be made through stamping, drilling, milling, turning, or other machining methods. The first magnetic member 20*a* can be fixed to the annular groove 131 through a fixing method such as bonding, locking, riveting, or the like.

As shown in FIG. 8, a difference between this embodiment and the second embodiment is that in this embodiment, there is no annular groove 131 on a second side surface 13, and the first magnetic member 20*b* can be directly fixed to the second side surface 13 through a fixing method such as bonding, locking, riveting, or the like.

Although the instant disclosure has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A sound transmission device, comprising:

a main body comprising a sound transmission opening;

a first magnetic member fixed to the main body and adjacent to the sound transmission opening; and a cover assembly comprising an outer cover, a second magnetic member, and a fixing member, wherein the second magnetic member is fixed between the outer cover and the fixing member, the cover assembly is magnetically attached to the first magnetic member through the second magnetic member, so that the outer cover covers the sound transmission opening, the outer cover comprises a through hole, and the through hole is in communication with the sound transmission opening;

wherein the outer cover comprises a cover plate and a circumferential plate, the circumferential plate extends vertically from a periphery of the cover plate, and the fixing member is fixed to an end of the circumferential plate that is away from the cover plate.

2. The sound transmission device according to claim 1, wherein the outer cover is a mesh cover body, and the through hole comprises a plurality of through holes.

3. The sound transmission device according to claim 1, wherein the end of the circumferential plate that is away from the cover plate and the fixing member are fixed to each other, and the second magnetic member is fixed between the cover plate and the fixing member.

4. The sound transmission device according to claim 3, wherein the second magnetic member comprises a first ring portion, a second ring portion, and an annular groove, the second ring portion is located on a side of the first ring portion that is away from the cover plate, an outer circumferential wall of the first ring portion is in contact with an inner circumferential wall of the circumferential plate, the second ring portion is contracted relative to the outer circumferential wall of the first ring portion to form the annular groove, and the fixing member is accommodated in the annular groove.

5. The sound transmission device according to claim 4, wherein the outer cover is a metal cover, and the fixing member is a metal ring.

6. The sound transmission device according to claim 5, wherein the main body comprises a first side surface and a second side surface that are opposite to each other, the first side surface is provided with an accommodating groove, the cover assembly is accommodated in the accommodating groove, and the sound transmission opening is located at a bottom of the accommodating groove.

7. The sound transmission device according to claim 4, wherein the main body comprises a first side surface and a second side surface that are opposite to each other, the first side surface is provided with an accommodating groove, the cover assembly is accommodated in the accommodating groove, and the sound transmission opening is located at a bottom of the accommodating groove.

8. The sound transmission device according to claim 7, wherein the first magnetic member is fixed to the second side surface.

9. The sound transmission device according to claim 8, wherein the first magnetic member and the main body are fixed to each other through insert molding.

10. The sound transmission device according to claim 9, wherein the first magnetic member comprises a through hole, the main body comprises an embedded portion, and the embedded portion is fixed in the through hole.

11. The sound transmission device according to claim 3, wherein a plurality of solder joints or welding joints are provided on the end of the circumferential plate that is away from the cover plate and the fixing member, and the solder joints or welding joints are annularly arranged between the circumferential plate and the fixing member.

12. The sound transmission device according to claim 1, wherein the outer cover is a metal cover, and the fixing member is a metal ring.

13. The sound transmission device according to claim 1, wherein the cover assembly comprises a waterproof layer, and the waterproof layer is located between the outer cover and the second magnetic member and covers the sound transmission opening.

14. The sound transmission device according to claim 13, wherein the cover assembly comprises a sealing layer, and the sealing layer is located between the waterproof layer and the second magnetic member and surrounds the sound transmission opening.

15. The sound transmission device according to claim 1, further comprising a seal ring, wherein the seal ring is located between the cover assembly and the main body and surrounds the sound transmission opening.

16. The sound transmission device according to claim 1, wherein the main body comprises a first side surface and a second side surface that are opposite to each other, the first side surface is provided with an accommodating groove, the cover assembly is accommodated in the accommodating groove, and the sound transmission opening is located at a bottom of the accommodating groove.

17. The sound transmission device according to claim 16, wherein the first magnetic member is fixed to the second side surface.

18. The sound transmission device according to claim 1, wherein the first magnetic member and the main body are fixed to each other through insert molding.

19. The sound transmission device according to claim 18, wherein the first magnetic member comprises a through hole, the main body comprises an embedded portion, and the embedded portion is fixed in the through hole.

* * * * *